US006658227B2

(12) United States Patent
Oyama et al.

(10) Patent No.: US 6,658,227 B2
(45) Date of Patent: Dec. 2, 2003

(54) DEVELOPMENT METHOD APPARATUS, IMAGE FORMATION AND PROCESS CARTRIDGE FOR SUPPRESSING VARIATION IN TONER CHARGE

(75) Inventors: Hajime Oyama, Tokyo (JP); Tsukuru Kai, Tokyo (JP); Katsuhiro Aoki, Tokyo (JP); Takashi Hodoshima, Tokyo (JP); Yasuo Miyoshi, Tokyo (JP); Ichiro Kadota, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 10/188,756

(22) Filed: Jul. 5, 2002

(65) Prior Publication Data

US 2003/0035663 A1 Feb. 20, 2003

(30) Foreign Application Priority Data

Jul. 6, 2001 (JP) ..... 2001-206615
Jun. 14, 2002 (JP) ..... 2002-174092

(51) Int. Cl.[7] ..... G03F 15/08

(52) U.S. Cl. ..... 399/267; 399/274; 399/282; 399/284

(58) Field of Search ..... 399/281, 282, 399/283, 284, 285, 267, 270, 272, 274, 236; 430/120, 122

(56) References Cited

U.S. PATENT DOCUMENTS 4,930,438 A * 6/1990 Demizu et al. ..... 399/281
6,032,012 A * 2/2000 Hirono et al. ..... 399/283
6,295,437 B1 9/2001 Hodoshima et al.
6,366,751 B1 4/2002 Shakuto et al.
6,385,423 B1 5/2002 Kai
6,442,364 B2 8/2002 Kai et al.
6,449,452 B1 9/2002 Kai
6,456,806 B2 9/2002 Shoji et al.

FOREIGN PATENT DOCUMENTS

| | | |
|---|---|---|
| JP | 56-40862 | 4/1981 |
| JP | 59-172662 | 9/1984 |
| JP | 11-52704 | 2/1999 |
| JP | 2000-321871 | 11/2000 |

* cited by examiner

*Primary Examiner*—Joan Pendegrass
(74) *Attorney, Agent, or Firm*—Oblon, Spivak, McClelland, Maier & Neustadt, P.C.

(57) ABSTRACT

The development is performed under a condition that $|Q2|-|Q1|/|Q1| \leqq \pm 0.45$. Here, Q1 denotes an average amount of charge on toner held on a development roller and carried toward a development region immediately before development. Q2 denotes an average amount of charge on toner immediately before development held and carried toward the development region in the state immediately after development of an electrostatic latent image on a development drum. This is effective to allow the amount of charge q/m on toner held on the development roller to have a variation rate of 45% or below and an afterimage rate R within 2%.

26 Claims, 6 Drawing Sheets

DEVELOPMENT METHOD APPARATUS, IMAGE FORMATION AND PROCESS CARTRIDGE FOR SUPPRESSING VARIATION IN TONER CHARGE

FIELD OF THE INVENTION

The present invention relates to a development method and apparatus for use in image formation apparatus such as printers, facsimiles and copiers, and also relates to an image formation apparatus and a process cartridge. More particularly, it relates to a development method of developing an electrostatic latent image formed on an image carrier using a developer held on a developer carrier to form a toner image on the image carrier at a development region (development nip region) between the developer carrier and the image carrier opposing thereto. The present invention further relates to a development apparatus for executing the development method, an image formation apparatus using the development apparatus and a process cartridge including the development apparatus mounted thereon.

BACKGROUND OF THE INVENTION

Conventionally known development systems for developing the electrostatic latent image on the image carrier in the development nip region are classified into a two-component development type and a one-component development type. The former employs a two-component developer that contains toner and magnetic particles to develop the electrostatic latent image. The latter employs a one-component developer consisting only of toner to develop the electrostatic latent image.

The two-component development system holds the two-component developer consisting of toner and magnetic particles in the form of a brush to form a magnetic brush on the surface of a developer carrier that contains magnets inside. When only toner from the magnetic brush is attached to the electrostatic latent image formed on the image carrier at the development region (development nip region) between the developer carrier and the image carrier opposed thereto, a toner image is formed on the image carrier. This two-component development system is known as an excellent development system because it has a stable and nice transfer property of toner images and development property against temperature and humidity.

In the one-component development system, on the other hand, the one-component developer consisting only of toner is held in the form of a uniform thin film on the surface of the developer carrier. The toner held on the surface of the developer carrier is opposed to an electrostatic latent image formed on the image carrier in a contact or non-contact state. When the toner attaches to the electrostatic latent image at the development region (development nip region) between the developer carrier and the image carrier opposing thereto, a toner image is formed an the image carrier. This one-component development system is known as an advantageous development system because it can provide an image with a high image quality and high resolution. The one-component development system does not employ the magnetic particles like the developer in the two-component development system and accordingly has no disadvantage to cause a development variation due to the magnetic brush that contacts with the surface of the image carrier. Therefore, it is possible to perform development that is highly faithful to the electrostatic latent image.

A development system that has advantages of the one- and two-component development types in combination has been proposed as a development apparatus that employs a developer carrier serving as a toner supplier member having a magnetic brush composed of a two-component developer formed on the surface. In the development apparatus, the magnetic brush on the toner supplier member is employed to supply a one-component developer composed only of toner to the developer carrier serving as a toner carrier (see Japanese Patent Application Laid-Open Nos. 56-40862 and 59-172662, for example).

In these development apparatus, the two-component developer is agitated in the development apparatus to hold the two-component developer on the toner supplier member (such as a magnetic roller and a magnetic brush forming member) to form a magnetic brush. The toner in the magnetic brush is charged to have a certain polarity through friction with magnetic particles. From the magnetic brush on the toner supplier member, only the toner charged to have a certain polarity is displaced to and held on the toner carrier (such as a development roller and a toner layer holding member).

This development apparatus can reduce the stress that is imparted on the toner carrier and the toner more effectively compared with the one-component development system. In addition, as it performs development in the one-component development system, a high image-quality same as that in the one-component development system can be achieved.

In any development systems, however, the above development apparatus have the following subject matters.

After the electrostatic latent image on the image carrier is developed (visualized), the developer layer on the developer carrier is divided into a toner-consumed layer and a toner-resided layer. In the toner-consumed layer, toner corresponding to the image section in the electrostatic latent image is consumed by the development. In the toner-resided layer, toner corresponding to the non-image section in the electrostatic latent image is resided, not consumed.

In such the development apparatus, a difference between the toner-consumed layer and the toner-resided layer occurs in an amount of toner held on the surface of the developer carrier. To resolve the difference in the amount of toner held on the developer carrier, it is required to supply a new toner to the toner-consumed layer through rotations of the developer carrier by an amount corresponding to the consumed amount. It is difficult in practice, however, to supply the new toner only to the toner-consumed layer on the surface of the rotating developer carrier. Accordingly, it is not possible to resolve the difference in the amount of toner held on the developer carrier using the method of simply supplying the new toner. As a result, such the development apparatus causes a hysteresis. For example, due to the difference in the amount of toner held on the developer carrier, an afterimage (ghost) appears as a density difference in an image at the time of a subsequent development.

In order to resolve such the hysteresis, it is effective to once remove the developer from a location in the surface of the developer carrier after developing (visualizing) the electrostatic latent image on the image carrier. A new developer is then supplied to the location in the surface of the developer to resolve the above-described difference in the amount of toner held on the surface of the developer carrier.

To execute such the method of removing and supplying the developer, the development apparatus requires a developer replacement unit which replaces the developer held on the developer carrier. The developer replacement unit may include a blade, scraper or brush roller as a unit which contacts with the surface of the developer carrier to mechanically remove the whole developer from the developer carrier. If such the unit is employed, however, the abrasion over time of the surface of the developer carrier changes the properties of carrying and holding the developer and invites a malfunction because toner spent is caused from the stress during removal. Also in this case, it is required to ensure a space for installing the blade, scraper or brush roller around the developer carrier, resulting in a larger body of the development apparatus.

An approach for resolving such the malfunction due to the use of the mechanical developer replacement unit employs an arrangement of magnetic poles of magnets arranged inside the developer carrier to remove the developer on the developer carrier magnetically. This approach can not be applied to the one-component development apparatus that employs non-magnetic toner, however, although it is effective in the two-component development apparatus and the one-component development apparatus that employs magnetic toner.

Japanese Patent Application Laid-Open No. 6-67546 proposes a development apparatus that can remove the developer (toner) from the developer carrier without the use of the above mechanical developer replacement unit and the magnets. This development apparatus has advantages of the one- and two-component development types in combination. It includes an electric field switcher unit which switches an electric field located across the developer carrier and the toner carrier to shift toner intermittently from the toner carrier to the developer carrier. In this development apparatus, the electric field switcher unit is employed to remove toner from the toner carrier without imparting a large mechanical stress on the toner and the surface of the toner carrier for holding the toner. In addition, it is possible to provide a highly reliable development apparatus that does not cause the above hysteresis. The development apparatus has disadvantages, however, because of complications in configurations of the apparatus itself and the electric field switcher unit as well as increased costs.

It is generally considered that the above hysteresis is caused from a difference in the amount of toner held on the surface of the developer carrier between the toner-consumed layer and the toner-resided layer held on the surface of the developer carrier after development.

In the conventional development apparatus, even if the amount of toner held on the surface of the developer carrier is an amount neither short nor over but sufficient to develop the electrostatic latent image, an afterimage maybe caused supposedly due to the hysteresis. For example, as shown in FIG. 3A, a draft image having a black solid section A at the top left, a non-image section (or white image section) B at the top light and a low contrast section C at the rear can be employed to forman image. In this case, an afterimage may be formed while a sufficient amount of toner is supplied to the surface of the developer carrier. In a normal print image formed using the draft image, as shown in FIG. 3B, a low contrast print image c corresponding to the low contrast section C is expected to have a uniform image density. In a practical print image, however, a low contrast print image corresponding to the low contrast section C may include a low contrast print image c2 at a part immediately beneath a blank image b corresponding to the non-image section B as shown in FIG. 3C. This low contrast print image c2 has an image density darker than that of a low contrast print image c1 at a part immediately beneath a black solid image a corresponding to the black solid print image section A as a phenomenon (hereinafter referred to as an "afterimage phenomenon").

The Inventors have researched through various experiments to study the cause of such the phenomenon and consequently found the following fact. In the case of the draft image having the non-image section B as above, in the electrostatic latent image formed on the image carrier, a part corresponding to the non-image section B has a potential equal to the ground potential on the image carrier. Therefore, when the toner held on the developer carrier which forms the low contrast print image c2 opposes to the part corresponding to the non-image section B on the surface of the image carrier, a charge is injected into the toner from the developer carrier that holds the toner. Because the surface potential on the image carrier corresponding to the non-image section B has a large potential difference from the development bias that has the opposite polarity and is applied to the developer carrier.

This potential difference reduces an amount of charge (q/m) on toner held on the developer carrier which forms the low contrast print image c2. This reduction in the amount of charge on toner lowers a force of the toner for attaching to the surface of the developer carrier. Accordingly, a much lager amount of toner tends to attach to the low contrast print image c2 at the part immediately beneath the blank image b corresponding to the non-image section B. As a result, the low contrast print image c2 comes to have an image density darker than that of the low contrast print image c1 at the part immediately beneath the black solid image a corresponding to the black solid print image section A.

SUMMARY OF THE INVENTION

It is an object of this invention to provide a development method capable of forming a uniform dense image by suppressing a variation in an amount of charge (q/m) on toner held on a developer carrier to reduce an afterimage phenomenon. An image formation apparatus that employs the development apparatus and a process cartridge that includes the development apparatus mounted thereon are also provided.

According to one aspect of the present invention, the amount of charge q/m on toner held on the surface of the developer carrier comes to have a variation rate of 45% or below. Such the variation rate can lower an afterimage rate R to 2% or below. This is effective to suppress the above-described afterimage phenomenon and give a toner density variation within tolerance to the toner image. The variation rate of the amount of charge q/m on toner is defined as a variation rate between charges before and after the charge injection into the toner. The afterimage rate R is defined as a ratio calculated on the basis of an optical reflectivity ID2 at the low contrast print image c2 and an optical reflectivity ID1 at the low contrast print image c1, using the following equation, $R=\{(ID1-ID2)/(ID1+ID2)\}\times 100\%$.

According to another aspect of the present invention, the amount of charge q/m on toner held on the surface of the developer carrier comes to have a variation rate of 45% or below. It is effective to form a uniform dense toner image on the image carrier with the absolute value of an afterimage rate $|R|$ within 2% and the suppressed afterimage phenomenon.

According to still another aspect of the present invention, the toner layer held on the surface of the developer carrier contacts with the conductive member. This allows the charge injected from the image carrier to the toner to be dissipated through the conductive member and the amount of charge on toner once reduced by the charge injection to be restored to the previous charge amount before reduction. This is effective to form a uniform dense toner image on the image carrier with the suppressed afterimage phenomenon.

According to still another aspect of the present invention, the development apparatus according to the above-mentioned aspects is employed as a development unit in the image formation apparatus.

According to still another aspect of the present invention, the development apparatus according to the above-mentioned aspects is employed as a development unit in the process cartridge for use in an image formation apparatus.

Other objects and features of this invention will become apparent from the following description with reference to the accompanying drawings.

DETAILED DESCRIPTIONS

The present invention will be explained below with respect to an embodiment applied to a printer or an image formation apparatus. This embodiment may also be applied to a copier and a facsimile.

Prior to the explanation of this embodiment, the printer with the application of the present invention is explained first. A brief arrangement of the major part in the printer is shown in FIG. 1.

Figure 1:
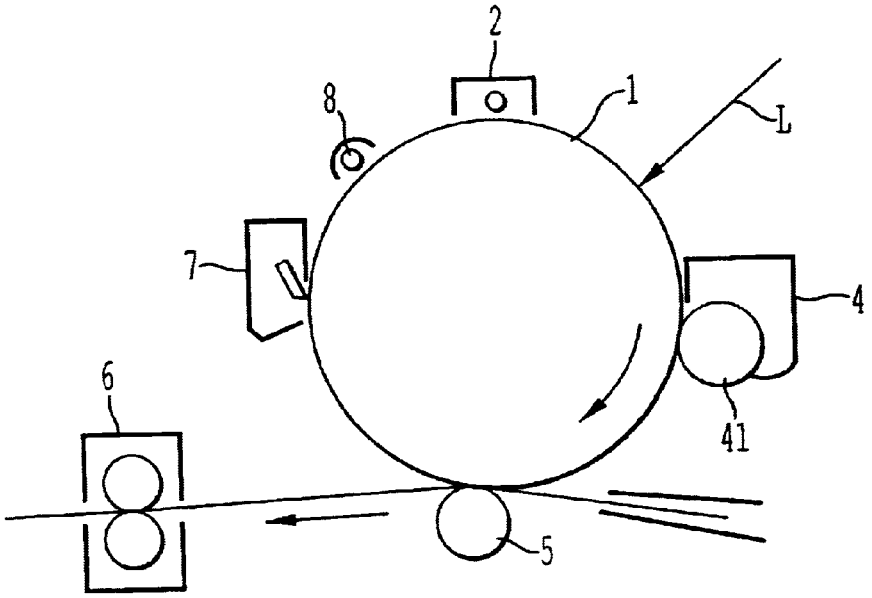
FIG. 1 is a brief arrangement diagram which shows the present invention applied to a printer.

In FIG. 1, an arrangement around a photosensitive drum 1 which is an image carrier includes, a charger 2 such as a charging roller as a charger unit which uniformly charges the surface of the photosensitive drum 1, an exposing device, not depicted, for emitting a laser light L to form an electrostatic latent image on the surface of the photosensitive drum 1 once uniformly charged by the charger 2, a development device 4 as a development unit which attaches charged toner to the electrostatic latent image formed by the exposing device on the surface of the photosensitive drum to form a toner image, a transfer device 5 as a transfer unit which transfers the toner image formed on the surface of the photosensitive drum 1 to a recording paper as a transfer material, a cleaner 7 as a cleaner unit which removes the residual toner stayed on the photosensitive drum 1 after transfer, and an eraser lamp 8 as an eraser unit which erases the residual potential on the photosensitive drum 1 after cleaning. The transfer device 5 available may include a transfer belt, a transfer roller and a transfer charger.

The photosensitive drum 1 is rotationally driven in the direction of the arrow shown in FIG. 1 to move the surface. On the surface of the photosensitive drum 1, after it is charged uniformly by the charger 2, an electrostatic latent image is formed by the laser light L. When the photosensitive drum 1 rotates, the electrostatic latent image is converted into a toner image at a development region on the photosensitive drum 1 using a charged toner contained in a developer supplied from the development device 4. The development region is a location that opposes to a development roller 41 provided as a developer carrier in the development device 4.

The toner image thus formed on the photosensitive drum 1 is carried to a location opposing to the transfer device 5 as the photosensitive drum 1 rotates, and transferred to a recording paper conveyed from a paper feed tray, not depicted. The recording paper having the toner image transferred thereon is conveyed on the transfer belt 5 toward a fixing device 6, which fixes the transferred toner image. On the other hand, the residual toner not transferred to the recording paper and resided on the photosensitive drum 1 is collected in the cleaner 7. The photosensitive drum 1, after the surface is cleaned, is then initialized at the eraser lamp 8 by removing the residual charge from the surface, and directed to the subsequent image formation process.

Figure 2:
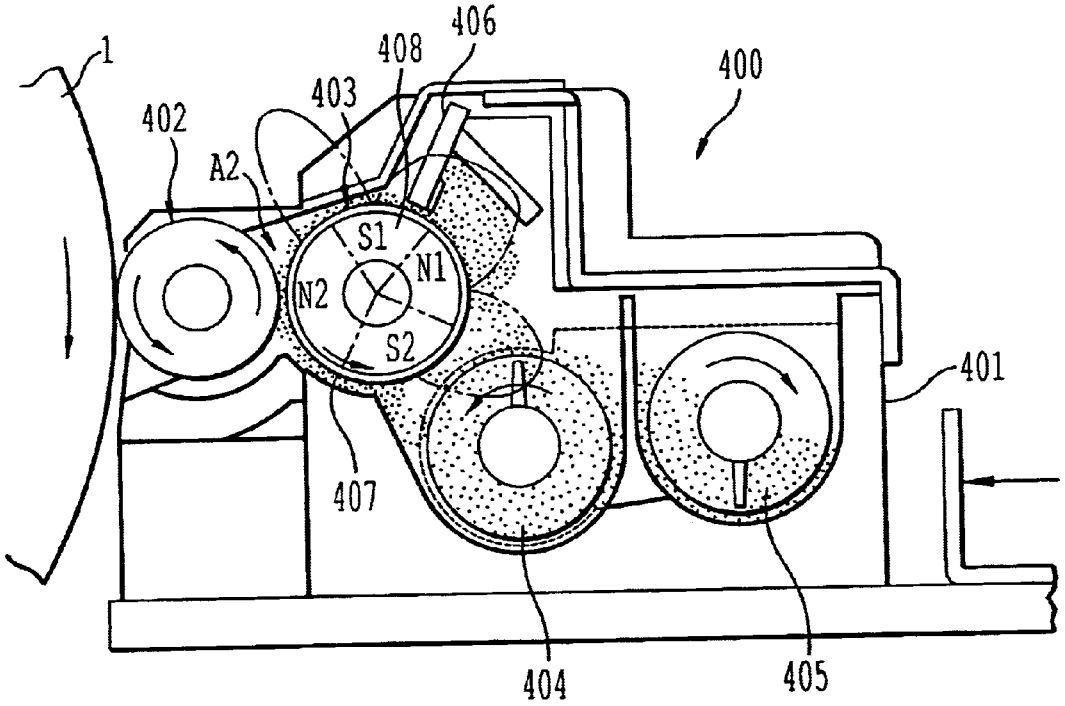
FIG. 2 is a brief arrangement diagram which shows a development apparatus in the present invention applied to the printer.

FIG. 2 shows an example of the development device 4, which is a one-component development device 400 that employs a magnetic brush roller of a two-component development type as a unit which supplies toner onto a development roller of a one-component type.

In FIG. 2, an arrangement inside a casing 401 of the one-component development device 400 includes, in turn from the photosensitive drum 1, a development roller 402 as a developer carrier (toner carrier), a magnetic brush roller 403 as a toner supplier member, and agitator/conveyer members 404, 405. The two-component developer (hereinafter simply referred to as "developer") in the casing 401 contains toner and magnetic particles (carrier). When the agitator/conveyer members 404, 405 agitate the developer, its part is held on the magnetic brush roller 403. The developer on the magnetic brush roller 403, having a thickness restricted at a restriction blade 406 as a developer restriction member, contacts the development roller 402 in a toner supply region A2. Of the developer on the magnetic brush roller 403, only toner separated from the carrier is supplied to the development roller 402 at the toner supply region A2.

The toner comprises a resin such as polyester, polyol and styreneacrylate mixed with a charge control agent (CCA) and a colorant, as well as a substance such as silica and titanium oxide added onto the outer surface of the resin to improve the fluidity. The additive has a particle diameter within a range between 0.1 and 1.5 ($\mu$m). The colorant includes carbon black, phthalocyanine blue, quinacridon and carmine. The charged polarity in this embodiment is negative.

The toner may comprise a matrix toner mixed with a dispersed wax and the like and an additive of the above type added on the outer surface of the matrix toner.

The toner has a volumetric average particle diameter, preferably within a range between 3 and 12 $\mu$m, and of 7 $\mu$m determined in this embodiment. Such the toner is sufficiently applicable to a high-resolution image of 1200 dpi or more.

The above carrier has a metallic or resinous core that contains a magnetic material such as Ferrite, and a surface layer that is covered with a silicon resin and the like. Preferably, it has a particle diameter within a range between 20 and 50 $\mu$m. As for its resistance, it has a dynamic resistance optimally within a range between 10 and $10^8$ Ω. A measured value of the dynamic resistance is obtained from a measurement, which comprises, attaching the magnetic particle on a roller that contains a magnet inside, contacting an electrode having an area of 50 mm wide and 1 mm long with the roller, and applying a voltage of the upper limit level of breakdown (from 400V for a high-resistance silicon coated carrier to several V for a low-resistance iron powder carrier).

The magnetic brush roller 403 includes a magnetic roller 408 having a plurality of magnetic poles arranged inside a rotatable non-magnetic sleeve 407. The magnetic roller 408 is secured operative to impart a magnetic force on the developer when the developer passes through a certain location.

In this embodiment, the sleeve 407 has a diameter of 18 millimeters, and its surface is sandblasted to achieve a surface roughness of 10 to 20 $\mu$m RZ.

The magnetic roller 408 has four magnetic poles N1, S1, N2, S2 arranged in the rotational direction of the magnetic brush roller 403 beginning from the location of the restriction blade 406. The toner and carrier held by the magnetic roller 408 on the surface of the sleeve 407 is held as the developer on the magnetic brush roller 403 and the toner obtains a required amount of charge when it is mixed with the carrier. In this embodiment, preferable amounts of charge on toner range between −10 to −40 [$\mu$C/g].

The development roller 402 opposes to a region at the magnetic pole S1 side of the magnetic roller 408 for forming a magnetic brush of the developer on the magnetic brush roller 403 in contact with the magnetic brush of the developer on the magnetic brush roller 403. It also opposes to the photosensitive drum 1 that serves as the image carrier.

The restriction blade 406 is in contact with the magnetic brush formed by the developer on the magnetic brush roller 403 at a location opposing to the magnetic brush roller 403. The development roller 402 and the magnetic brush roller 403 rotate in the directions of the arrows shown in FIG. 1, respectively. The magnetic brush roller 403 available may rotate in the reverse direction opposite to the depicted rotational direction.

The development roller 402 contacts with the photosensitive drum 1 to form an electrostatic latent image on the photosensitive drum 1. Typically, the photosensitive drum 1 includes an aluminum tube coated with an organic photosensitive material having photosensitivity to form a photosensitive layer. A belt photosensitive member may also be available. It includes a relatively thin base of polyethylene telephthalate (PET), polyethylene naphthalate (PEN) or nickel and a photosensitive layer formed thereon.

The above one-component development apparatus 400 operates in the following manner. The developer housed in the casing 401 is agitated when it receives the rotational forces from the agitator/conveyer members 404, 405 and the magnetic brush roller 403 as well as the magnetic force from the magnetic roller 408. When the toner and carrier in the developer are mixed and agitated, the toner 6 in contact with the carrier is charged frictionally.

A part of the developer held on the magnetic brush roller 403 is restricted by the restriction blade 406. As a result, a certain amount of the developer held on the magnetic brush roller 403 is shifted to the development roller 402 under the applied bias voltage and the remaining amount of the developer is returned to the casing 401.

In this embodiment, the closest part between the restriction blade 406 and the magnetic brush roller 403 is set to a gap of 500 $\mu$m. In addition, the magnetic pole N1 in the magnetic roller 408 opposing to the restriction blade 406 is located at upstream in the rotational direction of the magnetic brush roller 403 with a tilt of several degrees from the restriction blade 406. This is operative to easily form a circulating flow of the developer.

This embodiment assumes a stiff photosensitive drum 1 on the basis of the aluminum tube as the image carrier as described above. Therefore, the development roller 402 is preferably composed of a rubber material that has hardness within a range between 10 and 70 HS.JIS-A. The development roller 402 employed in this embodiment has a diameter of 10 to 30 mm and a roughness on the appropriately roughened surface, Rz, (a 10-point average roughness) of 1 to 4 [$\mu$m]. This value corresponds to 13 to 80 (%) of a volumetric average particle diameter of the toner that can be conveyed, not buried in the surface of the development roller 402. Available rubber materials may include silicone, butadiene, NBR, hydrin and EPDM.

If the so-called belt photosensitive member is employed as the image carrier, it is not required to lower the hardness of the development roller 402. Therefore, a metallic roller may also be available as the development roller 402.

Preferably, a coating material is appropriately coated over the surface of the development roller 402 to stabilize the quality over time. The development roller 402 in this embodiment is sufficient if it has a function only for carrying toner. Therefore, the development roller 402 is not required to frictionally charge the toner like the development roller in the conventional one-component development apparatus and is sufficient if it can satisfy an electric resistance, surface feature, hardness and dimensional accuracy, leaving widely increased options on materials.

The surface layer coating material for the development roller 402 may have a polarity opposite to or same as that of charge on the toner. In the former, a material that contains a resin such as silicone, akrylate and polyurethane or a rubber in the surface layer is exemplified. In the latter, a fluorine-containing material is exemplified. The so-called fluorine-containing material in Teflon series has a low surface energy and excellent release property, which is extremely effective to prevent occurrence of toner filming over time. Typical resinous materials include polytetrafluoroethylene (PTFE), tetrafluoroethylene-perfluoroalkylvinyl ether (PFA), tetrafluoroethylene-hexafluoropropylene polymer (FEP), polychlorotrifluoroethylene (PCTFE), tetrafluoroethylene-ethylene copolymer (FTFE), chlorotrifluoroethylene-ethylene copolymer (FCTFE), polyvinylidenefluoride (PVDF) and polyvinylfluoride (PVF).

A conductive material such as carbon black may often be appropriately contained in the above to achieve electrical conductivity. Another resin may be mixed with the above to uniformly coat the development roller 402. With respect to the electrical resistance, a volume resistivity in the bulk containing the coated layer is set to $10^3$ to $10^8$ Ω·cm by adjusting the resistance of the coated layer. The base layer used in this embodiment has a volume resistivity of $10^3$ to $10^5$ Ω·cm. Therefore, the volume resistivity of the surface layer may be set slightly higher.

Preferably, the coated layer has a thickness within a range between 5 and 50 μm. A large difference in hardness between the base layer and the coated layer with a thickness above 50 μm easily yields malfunctions such as cracks on occurrence of stress. If the thickness is less than 5 μm, the base layer is exposed through the progressively abraded surface, resulting in an easy attachment of toner.

The electric field effect caused from a voltage applied to the magnetic brush roller 403 transfers the toner onto the development roller 402. The toner is employed to develop the electrostatic latent image formed on the photosensitive drum 1 while the development bias is applied to the development roller 402. This is effective to form a toner image on the photosensitive drum 1. In this embodiment, the photosensitive drum 1 is set to have a line velocity of 200 mm/s and the development roller 402 a line velocity of 300 mm/s that is 1.1-fold or more. The photosensitive drum 1 has a diameter of 50 mm, the magnetic brush roller 403 a diameter of 18 mm, and the development roller 402 a diameter of 16 mm for use in the development process.

The toner image formed on the photosensitive drum 1 is then passed through the transfer and fixing steps to complete a print image.

Figure 3A:
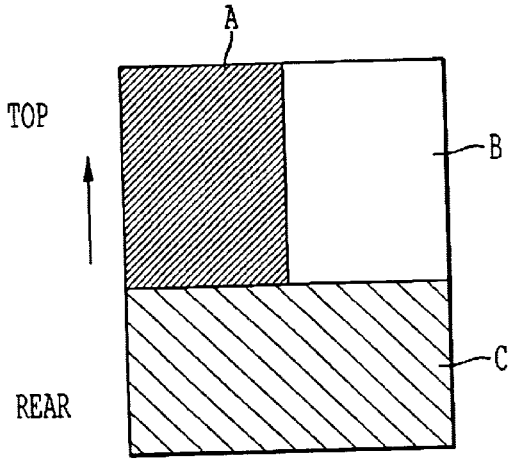
FIG. 3A is a brief plan view which shows an example of a draft image to be printed in the above printer.
Figure 3B:
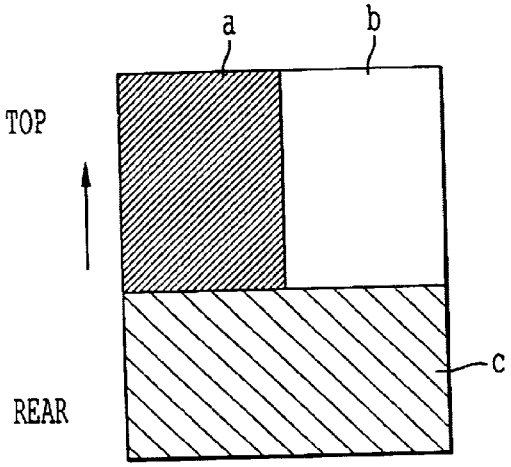
FIG. 3B is a brief plan view which shows a normal print image formed by the above printer.
Figure 3C:
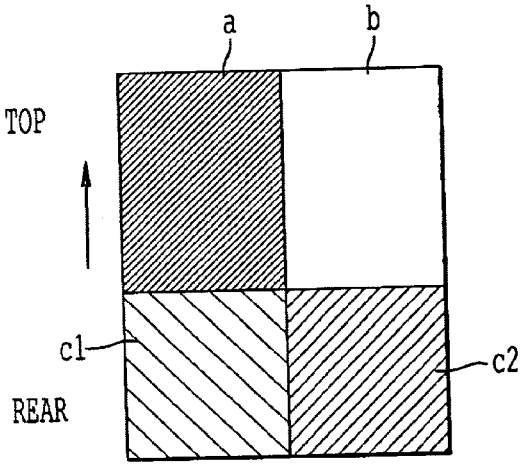
FIG. 3C is a brief plan view which shows an abnormal print image formed by the above printer.

In the development apparatus as described above, the development under the conventional condition may rise the afterimage supposedly caused from the hysteresis in the case of the draft image shown in FIG. 3A. This draft image has the black solid image A and the non-image section (or white image section) B at parts of the top and the low-contrast image section C at the rear. Specifically, as shown in FIG. 3C, a low contrast print image corresponding to the low contrast section C may include a low contrast print image c2 at a part immediately beneath a blank image b corresponding to the non-image section B. This low contrast print image c2 has an image density darker than that of a low contrast print image c1 at a part immediately beneath a black solid print image a corresponding to the black solid image section A, inviting an extreme image deterioration.

The afterimage rate in an afterimage state under the conventional development condition is calculated by the following equation, $R=\{(ID1-ID2)/(ID1+ID2)\}\times 100\%$. The obtained afterimage rate R=−2% or below exhibits a negative afterimage in a failed supplement state. The toner employed in this case has a particle diameter of 7 μm and the carrier a diameter of 50 μm. A silicon-coated dynamic resistance is $10^8\Omega$ and toner TC is 5 wt %. A rotational line velocity ratio of the magnetic brush roller 403 to the development roller 402 is αSu=2, and a supply potential difference is 400V.

The image formation condition in this case includes a charged potential on the surface of the photosensitive drum 1, VD=−450V, a potential after exposure, VL=−60V, a development bias, VB=−310V, a potential at the non-image section (the ground section), (VD−VB)=−140V, and a development potential at the image section (the solid print section), (VL−VB)=+250V, in which $|VL-VB| \geqq |VD-VB|$.

Figure 4:
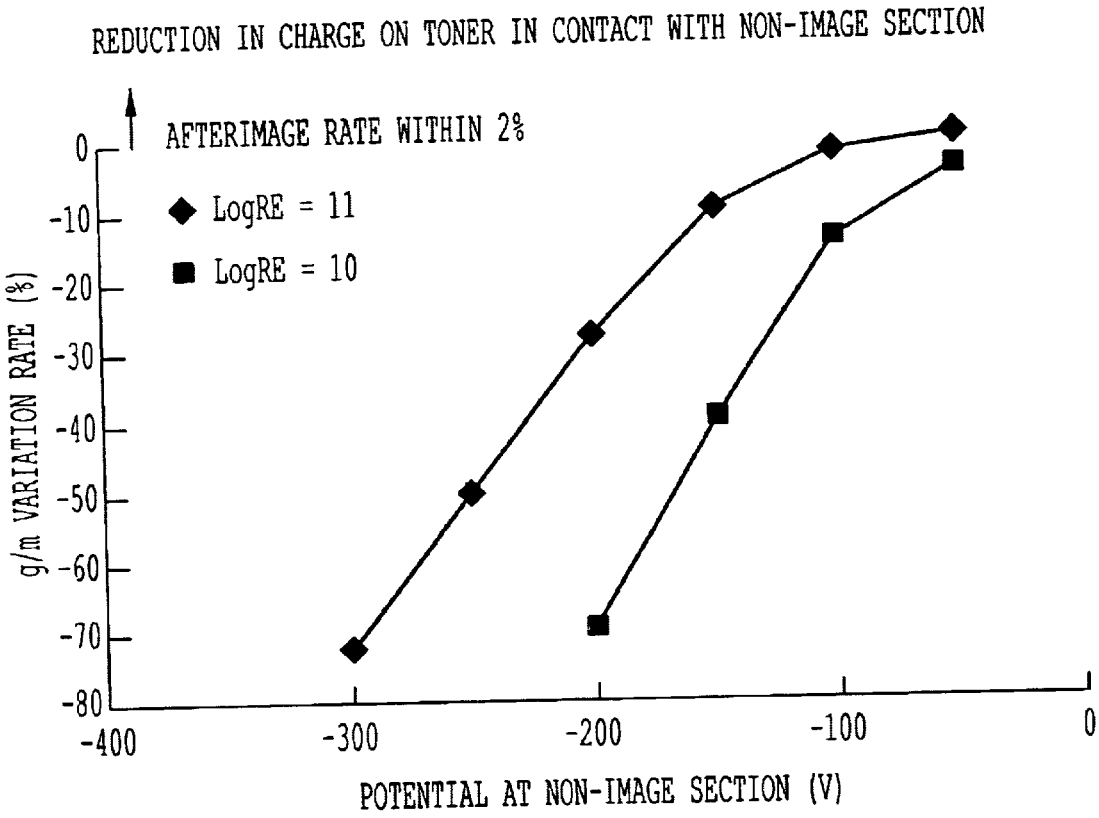
FIG. 4 is a graph which shows a variation rate in an amount of charge (q/m) on toner for use in the above printer relative to a potential (V) at a non-image section on a photosensitive drum.

As shown in FIG. 4, the common logarithms Log RE of a value RE obtained from the volume resistivity of toner R (Ω·cm) multiplied by the specific permittivity E can be as relatively large as 11. In this case, even if |VL−VB|=|VD−VB|, when the toner held on the development roller 402 contacts with the non-image section on the photosensitive drum 1, the reduction in charge on the toner can fall within 45% at most and the afterimage rate R within tolerance. To the contrary, if the common logarithms Log RE is as relatively small as 10, when |VD−VB| is on a level of 170V that is obviously smaller than |VL−VB|, the afterimage rate R may exceed the tolerance level of 2%.

As above, in such the development apparatus, an image with the most excellent quality can be obtained at the afterimage rate R not more than 5% and a permissible nice image with the afterimage rate R between 0.5% and 2%. If the afterimage rate R exceeds 2%, the afterimage invites an extremely deteriorated image. The afterimage rate R employed in either case is the absolute value.

As a result of researching such the afterimage phenomenon, the following charge injection is found as the cause. When the toner on the developer carrier which forms the low contrast print image c2 opposes to the part corresponding to the non-image section B on the surface of the image carrier, a charge is injected to the toner from the developer carrier that holds the toner. This charge injection is caused from a large potential difference between the surface potential on the image carrier corresponding to the non-image section B and the development bias with the opposite polarity that is applied to the developer carrier.

The occurrence of the above charge injection reduces an amount of charge (q/m) on toner held on the developer carrier which forms the low contrast print image c2. This reduction in the amount of charge on toner lowers a force of the toner for attaching to the surface of the developer carrier. Accordingly, a much larger amount of toner is attached to the electrostatic latent image in the low contrast print image c2 at the part immediately beneath the blank image b corresponding to the non-image section B. As a result, the low contrast print image c2 comes to have an image density darker than that of the low contrast print image c1 at the part immediately beneath the black solid print image a corresponding to the black solid image section A.

With respect to the above development apparatus, a relation between the ground potential on the photosensitive drum 1 and a charge variation rate (q/m variation rate) is researched. The q/m variation rate is defined as a variation rate between an "average amount of charge (q/m) on toner immediately after passed through a region between the developer carrier and the image carrier opposed thereto when a potential difference between the developer carrier and the image carrier surface is equal to 0V" and an "average amount of charge (q/m) on toner immediately after passed through the region between the developer carrier and the image carrier opposed thereto when a development voltage is applied to the developer carrier and a potential on the image carrier surface is equal to a potential on a non-image section". In addition, a relation between the q/m variation rate and the afterimage rate is researched. The "average amount of charge (q/m) on toner immediately after passed through a region between the developer carrier and the image carrier opposed thereto when a potential difference between the developer carrier and the image carrier surface is equal to 0V" is equal to 20 μC/g in the developer before supply. The "average amount of charge (q/m) on toner immediately after passed through a region between the developer carrier and the image carrier opposed thereto when a potential difference between the developer carrier and the image carrier surface is equal to 0V" is equal to 23

μC/g on the development roller. The photosensitive drum has a line velocity of 180 mm/sec. A line velocity ratio of the photosensitive drum to the development roller is equal to 1.5. A line velocity ratio of the development roller to the magnetic brush roller is equal to 2. The development potential is equal to 100V. The supply potential is equal to 100V.

As a result, such data as shown in Table 1 is obtained. In Table 1, the above "average amount of charge (q/m) on toner immediately after passed through a region between the developer carrier and the image carrier opposed thereto when a potential difference between the developer carrier and the image carrier surface is equal to 0V" is given by A (q/m), and the "average amount of charge (q/m) on toner immediately after passed through the region between the developer carrier and the image carrier opposed thereto when a development voltage is applied to the developer carrier and a potential on the image carrier surface is equal to a potential on a non-image section" is given by B (q/m).

TABLE 1

| Ground potential | A (q/m) | B (q/m) | Variation Rate | Afterimage rate % |
|---|---|---|---|---|
| −100 | 23 μC/g | 17.3 | −25 | −0.2 |
| −200 | | 16.1 | −30 | −0.5 |
| −300 | | 13.3 | −42 | −1.5 |
| −400 | | 10.4 | −55 | −3.0 |

Figure 5:
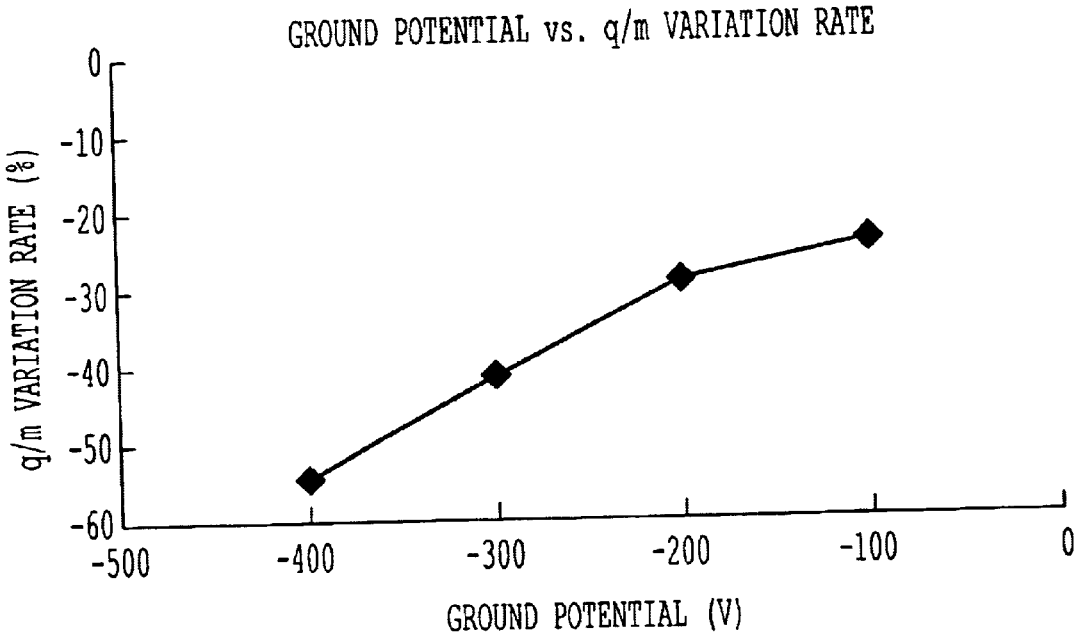
FIG. 5 is a graph which shows a variation rate in an amount of charge (q/m) on toner for use in the above printer relative to the ground potential (V) on the photosensitive drum.
Figure 6:
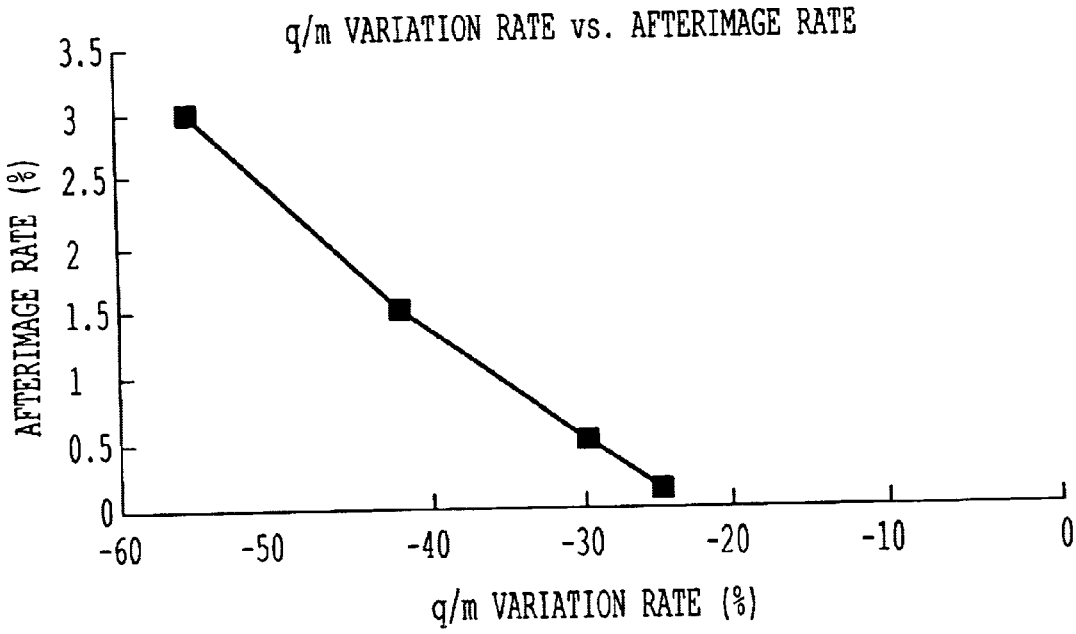
FIG. 6 is a graph which shows an afterimage rate in the print image formed by the development apparatus, which causes an afterimage phenomenon, relative to a variation rate in an amount of charge (q/m) on toner for use in the above printer.

FIG. 5 shows a graph obtained on the basis of the data shown in Table 1 which shows a relation between the variation rate of the amount of charge (q/m) on toner for use in the above printer and the ground potential (V) on the photosensitive drum. FIG. 6 shows a graph which shows a relation between the afterimage rate in the print image with the afterimage phenomenon formed by the development apparatus and the variation rate of the amount of charge (q/m) on toner for use in the above printer. As obvious from the graph shown in FIG. 6, if the variation rate (q/m variation rate) between the "average amount of charge (q/m) on toner immediately after passed through a region between the developer carrier and the image carrier opposed thereto when a potential difference between the developer carrier and the image carrier surface is equal to 0V" and the "average amount of charge (q/m) on toner immediately after passed through the region between the developer carrier and the image carrier opposed thereto when a development voltage is applied to the developer carrier and a potential on the image carrier surface is equal to a potential on a non-image section" has the absolute value of 45% or below, the afterimage rate R (absolute value) comes to 2% or below. This is effective to suppress an afterimage and obtain a nice image.

Figure 7:
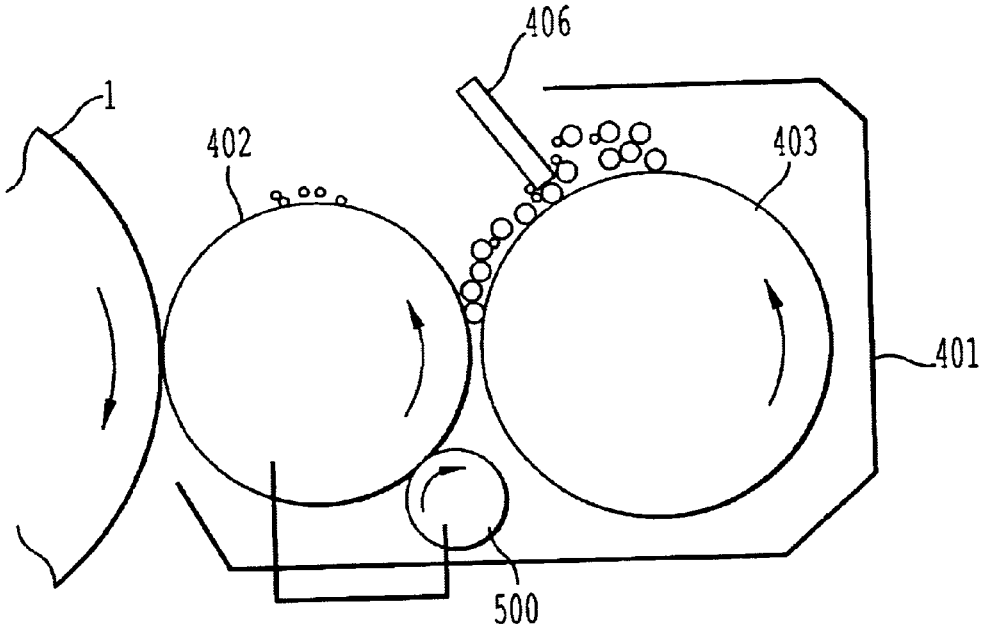
FIG. 7 is a brief arrangement diagram which shows an example of a development apparatus according to an embodiment of the present invention.

In such the development apparatus, for example, as shown in FIG. 7, a low-resistance roller (resistance, $10^8\Omega$ or below) is located in contact with the toner on the development roller 402 after passed through the development region. The low-resistance roller is composed of a conductive material, to which a voltage on a certain level (the same potential as that on the development roller 402 in this example) is applied. This is operative to reduce a variation in the amount of charge q/m on toner suffered during passage through the development region. This effect can be obtained when the common logarithms Log RE of the volume resistivity of toner R multiplied by the specific permittivity E has a value of 15 or below. It is effective to avoid a longer response time.

In the development apparatus of this embodiment, if the average amount of charge q/m (absolute value) on toner before development is retained on or above 10 μC/g, attachment of toner to the ground section on the photosensitive drum 1 can be reduced suitably.

The photosensitive drum 1 can be long-lived if $0<|VD|-|VB|<|VD-VL|<400V$, where VD denotes a potential at a dark section on the photosensitive drum 1, VL denotes a potential after exposure, and VB denotes a development bias voltage.

If the supply potential ΔVSu on the development apparatus is set to a value (100V in this example) less than 1.5 times the development potential, it is possible to form a thin stable toner layer with less variation even before development and obtain a uniform image without occurrence of any afterimage.

Preferably, the developer for use in the development apparatus of this embodiment has a 40% or more covering rate of toner over carrier. In general, the covering rate Tn over carrier is a function of the toner TC and can be calculated from the following equation (a single toner layer for covering), $$Tn = \frac{100C\cdot\sqrt{3}}{2\pi(100-C)(1+r/R)^2(r/R)(\rho_r/\rho_c)} \quad (1)$$

where C denotes TC [wt %], r denotes a toner particle radius, R denotes a carrier particle radius, $\rho_r$ denotes a true specific gravity of the toner, and $\rho_c$ denotes a true specific gravity of the carrier. In a combination of 50 μm-diameter carrier and 7 μm-diameter toner, the covering rate is 36.7% for TC=5 wt %, 40.6% for TC=5.5 wt % and 44.5% for TC=6 wt %. When images are compared under three conditions, a uniform image can be obtained without problem if TC is equal to 5.5 wt % or more, that is, the covering rate is 40% or more. To the contrary, if TC is less than 5.5 wt %, a low-contrast image immediately after solid consumption has a lower density.

It can be considered that the covering rate of toner over carrier contributes to highly efficient toner development as far as possible. The definition on the covering rate is applicable even in the case of the toner particle diameter changed, for example. In comparison of toners having particle diameters of 6 μm and 5 μm using the above equation, while the current 7 μm-diameter toner has the lower limit of TC=5.5 wt %, the 6 μm-diameter toner 4.6 wt %. As for the 5 μm-diameter toner, the lower limit is 3.8 wt %. Thus, the smaller the toner has a particle diameter, the lower the toner TC can be reduced while retaining the covering rate. In addition, it is possible to prevent bad influences such as toner scattering (see FIG. 3C). The covering rate below 40% reduces the development ability immediately after solid consumption even if a variation in the toner charge amount is below 50%, resulting in an afterimage that deteriorates the image quality.

With respect to the two-component development apparatus, a relation between a toner TC (the weight ratio of toner to carrier) in the developer during toner supply and the image quality will be explained next. In the two-component development type, the developer (toner+carrier) used in this embodiment has a toner TC of 5–8 wt % for toner to carrier. The toner employed has a particle diameter of 7 μm and the carrier has a particle diameter of 50 μm. If the gap between the development sleeve and the photosensitive drum is set to 0.6 mm and the development potential is 550 [V], a uniform image can be obtained, hardly causing an abnormal image named as afterimage (ghost).

In contrast, in the one-component development apparatus 400 shown in FIG. 2, in addition to the magnetic brush roller 403, the development roller 402 is arranged. A gap between the magnetic brush roller 403 and the development roller 402, which corresponds to the development sleeve in the two-component development apparatus, is set to 0.6 mm, between which a supply potential difference is set in accordance with a difference in applied bias voltages. The value is 1.5 times the development potential of 250V or below, for instance, 100 [V] in this example. If the toner TC in the developer 7 is set to 5 wt %, the low-contrast image immediately after solid consumption has a lower density compared to that without solid consumption, resulting in the afterimage as described above. If the toner TC in the developer is set to 5.5 wt %, toner can be supplied sufficiently even immediately after solid consumption, resulting in no afterimage found in the image.

The rotational line velocity ratio of the magnetic brush roller 403 to the development roller 402, in this example, the development roller 402 is located not in contact with the two-component development apparatus. There is no contact with a member corresponding to the developer replacement unit which peels (removes) the toner off the surface of the development roller 402.

Across the development roller 402 and the magnetic brush roller 403, an electric field is created due to a potential difference between bias voltages applied to both. Unless the supply is performed at or below this supply potential difference $\Delta Vsu=Vsu-VB=150V$, when the development roller 402 is operated before development, the amount of toner attached on the development roller 402 increases. In this case, the toner supply ability to the development roller 402 after solid consumption inevitably lowers.

To compensate such the reduction in the toner supply ability, it is effective to elevate the rotational line velocity ratio of the magnetic brush roller 403 to the development roller 402. The toner employed has a particle diameter of 7 $\mu$m, the carrier a particle diameter of 50 $\mu$m, and a silicone-coated dynamic resistance $10^8\Omega$ or below. The toner TC is 5 to 8 wt %. Only the rotational line velocity is varied under the same condition to compare states of afterimage occurrences using afterimage rates. As a result, in a range of the rotational line velocity ratio of the magnetic brush roller 403 to the development roller 402, $\alpha Su>2.0$, they are on a level without problems. The magnetic brush on the magnetic brush roller 403 is in contact with the development roller 402 at a level without leakage of the agent.

If a condition is set for stabilizing the amount attached to the development roller 402 before development by the magnetic brush roller 403, the toner supply ability to the development roller 3 after solid consumption inevitably lowers. In a compensation method for that case, the carrier in the developer on the magnetic brush roller 403 has a resistivity of $10^3\Omega$ or less. An applied voltage is on a level of several volts. The toner employed has a particle diameter of 7 $\mu$m; and the carrier a particle diameter of 50 $\mu$m. The toner TC is 5 wt %. The rotational line velocity ratio of the magnetic brush roller 403 to the development roller 402, $\alpha Su$, is 2 times.

The development apparatus in the printer according to this embodiment may be employed as a development apparatus in a color image formation apparatus.

Figure 8:
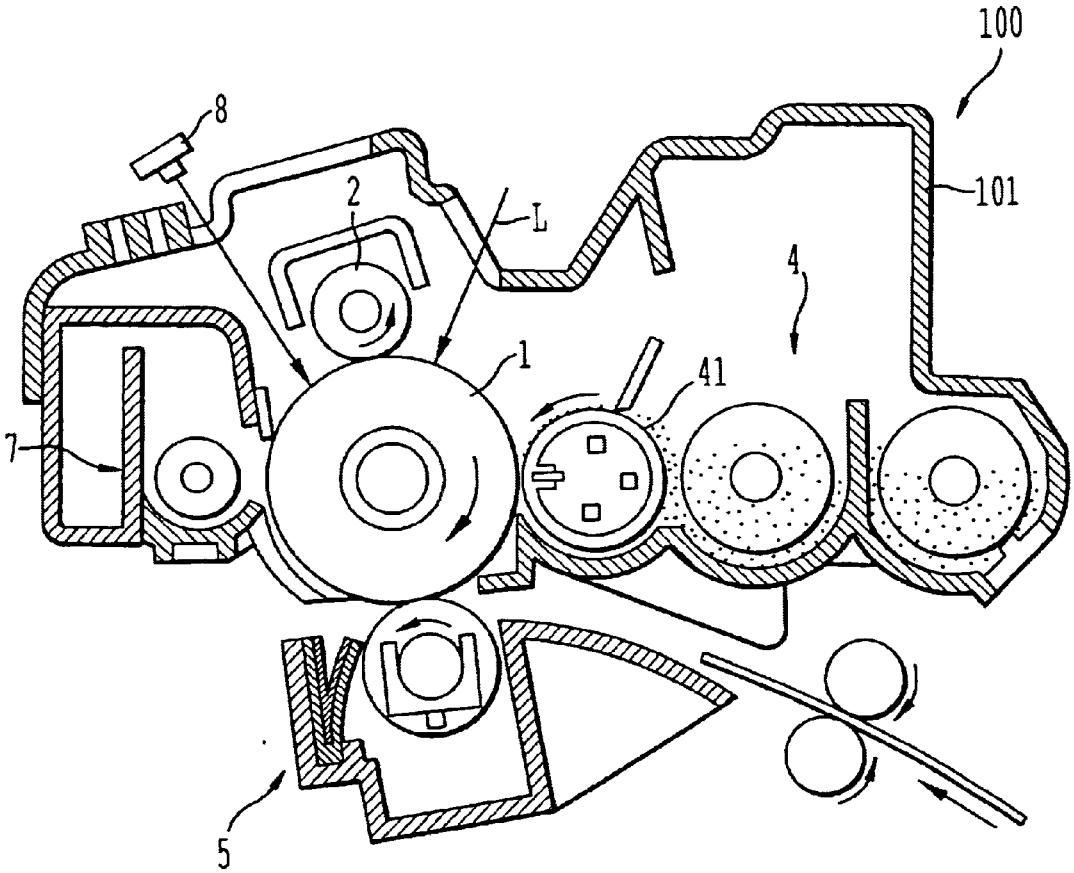
FIG. 8 is a brief arrangement diagram which shows an example of a process cartridge that includes a development apparatus mounted thereon, according to another embodiment of the present invention.

The development apparatus may also be employed as a development apparatus in a process cartridge. FIG. 8 shows a brief arrangement of a process cartridge 100, which includes a low-potential process development apparatus 4 mounted thereon.

The process cartridge 100 includes, as shown in FIG. 8, the above-described photosensitive drum 1, the charger 2, the development apparatus 4 and the cleaner 7. These machines for image formation are integrally arranged within a cartridge case 101. The process cartridge 100 is detachably attached to the body of the image formation apparatus such as a copier and a printer.

In the image formation apparatus that includes the process cartridge 100, the photosensitive drum 1 is rotationally driven at a certain circumferential speed. While the photosensitive drum 1 rotates, its surface is uniformly charged to a certain positive or negative potential by the charger 2. Then, an image exposure light L from an image exposure unit of a slit exposure or laser beam scanning exposure type is employed to form an electrostatic latent image on the surface of the photosensitive drum 1. The electrostatic latent image formed on the surface of the photosensitive drum 1 is developed using the toner contained in the developer that is supplied from a development roller 41 of the development apparatus 4. The toner image thus formed on the surface of the photosensitive drum 1 is transferred onto a recording paper that is fed in between the photosensitive drum 1 and a transfer roller of the transfer device 5 from a paper feeder in synchronization with rotation of the photosensitive drum 1. The recording paper after image transfer is separated from the surface of the photosensitive drum 1, then introduced into a fixing device, not depicted, to fix the image, and printed out as a reproduced matter (copy) to outside the apparatus. The surface of the photosensitive drum 1 after image transfer is cleaned at the cleaner 7 by removing the residual toner therefrom, followed by erasing charge therefrom at the eraser 8, and repeatedly employed in image formation.

Such the process cartridge 100 is individually detachable from the body of the image formation apparatus. The photosensitive drum 1 and the development apparatus 4 both can be long-lived through the use of the above development apparatus 4 as described earlier. Both lifetimes are not always coincident with each other, however. The process cartridge 100 easily allows the photosensitive drum 1 and the development apparatus 4 to be replaced individually in such the case. The photosensitive drum 1 and the development apparatus 4 can be located individually. Accordingly, if a simple mechanism is additionally employed, the development roller 41 can be moved away from the photosensitive drum 1 during non-development. This is effective to reduce facilitation of the toner filming on the development roller 41 and further elongate the lifetime of the development apparatus 4.

Figure 9:
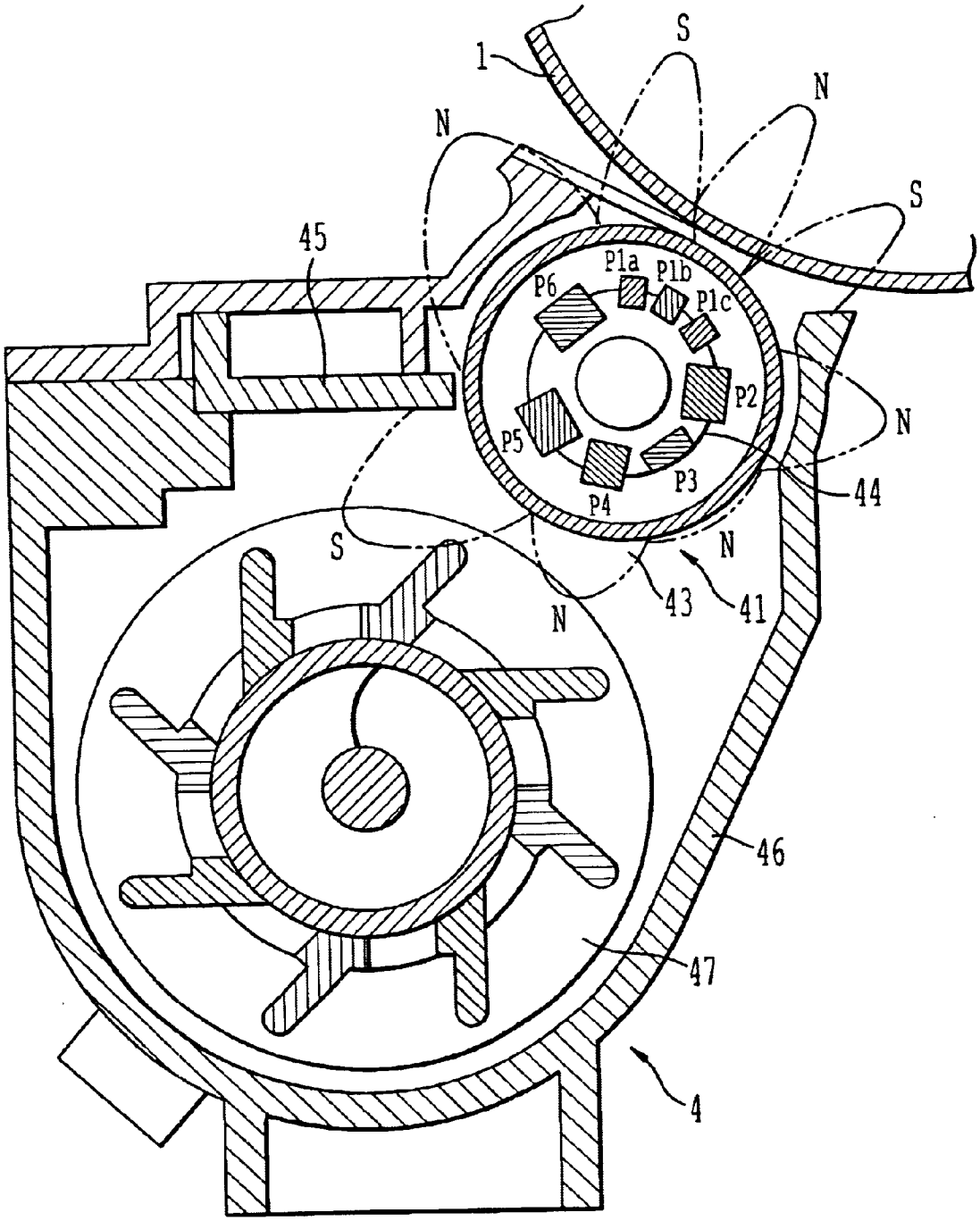
FIG. 9 is a brief arrangement diagram of a two-component development apparatus according to a further embodiment of the present invention.

FIG. 9 shows an example of a brief arrangement of a two-component development apparatus 4 available as the development apparatus for the above printer. In FIG. 9 a development roller 41 is located in the vicinity of the photosensitive drum 1. A development region is formed at a location between both opposing to each other. The development roller 41 includes a development sleeve 43 and a magnetic roller 44. The development sleeve 43 is composed of a non-magnetic material such as aluminum, brass, stainless steel and conductive resin and shaped in the form of a cylinder. The magnetic roller 44 is employed as a magnetic field generating unit which creates a magnetic field to rise the developer on the surface of the development sleeve 43. The above development region is defined as a range in which the magnetic brush on the development sleeve 43 is in contact with the photosensitive drum 1.

The development sleeve 43 is supported by a rotational drive mechanism, 500 as shown in FIG. 7, rotatably in the direction of the arrow (clockwise). The magnetic roller 44 is fixedly located in the development sleeve 43. As a result, the magnetic carrier in the developer housed in a development casing 46 of the development apparatus 4 rises in the form of a chain on the development sleeve 43 along lines of magnetic force generated from the magnetic roller 44. The charged toner in the developer is attached to the magnetic carrier rising in the form of a chain to form a magnetic brush on the surface of the evelopment sleeve 43.

As the development sleeve 43 rotates, the magnetic brush formed on the surface of the development sleeve 43 is conveyed in the same rotational direction as that of the development sleeve 43 or clockwise. On a location at upstream of the development region in the conveying direction of the developer, a doctor blade 45 is located as developer a restriction unit which restricts a height of the rising developer chain or an amount of the developer. In a region at the rear of the development roller 41 opposing to the photosensitive drum 1, a screw 47 is located to lift the developer up to the development roller 41 while agitating it in the development casing 46.

In the above development apparatus, a vibrating bias voltage consisting of a DC voltage and a superimposed AC voltage is applied to the development roller 41 during development as a development bias from a power source, not depicted. A potential on the background section and a potential on an image section are set in between the maximum and the minimum of the vibrating bias voltage. This is effective to create an alternating electric field with an alternately varying direction in the development region. In the alternating electric field, the toner and the carrier intensively vibrate in the developer, and the toner flies to the photosensitive drum 1, overcoming the static constrain force to the development roller 41 and the carrier, and attaches to the corresponding electrostatic latent image on the photosensitive drum 1.

Preferably, the vibrating bias voltage has a difference of 0.5 to 5 kV between the maximum and the minimum (peak-to-peak voltage) and a frequency of 1 to 10 kHz. The vibrating bias voltage may have a waveform of a rectangular, sine or triangular wave. The DC voltage component in the vibrating bias voltage has a value between the background potential and the image potential, preferably, a value closer to the background potential rather than the image potential to prevent the fogged toner from attaching to the background potential region.

If the vibrating bias voltage has the waveform of a rectangular wave, it is desirable to have a duty factor below 50%. The duty factor is defined as a ratio of a time required for toner to move toward the photosensitive drum 1 to one period of the vibrating bias. This is effective to increase a difference between a peak value and a time average value of the bias, which drives the toner toward the photosensitive material. Accordingly, it is possible to further activate the motion of the toner and improve the roughness and resolution after the toner attaches to the latent image surface faithfully to the potential distribution. This is also effective to decrease a difference between a peak value and a time average value of the bias, which drives the carrier, having the opposite polarity relative to the toner, toward the photosensitive drum 1. Accordingly, it is possible to inactivate the motion of the carrier and greatly decrease a probability that the carrier attaches to the background around the electrostatic latent image.

According to the present invention, the amount of charge q/m on toner held on the developer carrier comes to have a variation rate of 45% or below. Therefore, the afterimage rate R that can permit a toner density variation in the toner image falls within 2%. This is extremely effective to suppress the afterimage phenomenon in the image.

According to the present invention, the amount of charge q/m on toner held on the developer carrier comes to have a variation rate of 45% or below. This is extremely effective to form a uniform dense toner image on the image carrier with an afterimage rate R within 2% and a suppressed afterimage phenomenon.

According to the present invention, the toner layer held on the surface of the developer carrier contacts with the conductive member. This allows charge injected from the image carrier to the toner to be dissipated through the conductive member and the amount of charge on toner once reduced by the charge injection to be restored to the previous charge amount before reduction. This is extremely effective to form a uniform dense toner image on the image carrier with a suppressed afterimage phenomenon.

According to the present invention, the electrostatic latent image formed on the image carrier is converted into a toner image using the development apparatus according to the present invention. This is extremely effective to form a uniform-density, high-quality image with less afterimage phenomenon.

In particular, it is possible to form a high-accuracy latent image with low potential contrast on the image carrier and form a high-quality image. This is extremely effective to provide an image formation apparatus capable of reducing an electrostatic hazard on the surface of the image carrier.

According to the present invention, since the development apparatus according to the present invention is employed, it is possible to form a high-quality image. This is extremely effective to provide a process cartridge capable of reducing an electrostatic hazard on the surface of the image carrier.

The present document incorporates by reference the entire contents of Japanese priority documents, 2001-206615 filed in Japan on Jul. 6, 2001 and 2002-174092 filed in Japan on Jun. 14, 2002.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A development method, comprising:

providing a developer carrier which carries a toner-containing developer held on the surface thereof;

providing an image carrier which carries an electrostatic latent image formed on the surface thereof; and opposing the developer carrier to the image carrier in a development region to perform development of the electrostatic latent image formed on the image carrier using the developer held on the developer carrier to form a toner image on the image carrier, wherein the development is performed under a condition that satisfies the following relation $$|Q2|-|Q1|/|Q1| \leqq \pm 0.45$$

where Q1 denotes an average amount of charge on toner immediately after passed through a region between the developer carrier and the image carrier opposed thereto when a potential difference between the developer carrier and the image carrier surface is equal to 0V, and Q2 denotes an average amount of charge on toner immediately after passed through the region between the developer carrier and the image carrier opposed thereto when a development voltage is applied to the developer carrier and a potential on the image carrier surface is equal to a potential on a non-image section.

2. A development apparatus, comprising:

a developer carrier which carries a toner-containing developer held on the surface thereof;

a unit which forms the developer into a thin layer on the surface of the developer carrier; and a unit which charges toner held on the surface of the developer carrier, in which the developer held on the developer carrier is employed in a development region, where the developer carrier opposing to an image carrier which carries an electrostatic latent image formed on the surface thereof, to develop the electrostatic latent image formed on the image carrier to form a toner image on the image carrier, wherein the apparatus comprises a unit which controls an amount of charge on the toner, q/m, to satisfy the following relation $$|Q2|-|Q1|/|Q1|\leqq\pm0.45$$

where Q1 denotes an average amount of charge on toner immediately after passed through a region between the developer carrier and the image carrier opposed thereto when a potential difference between the developer carrier and the image carrier surface is equal to 0V, and Q2 denotes an average amount of charge on toner immediately after passed through the region between the developer carrier and the image carrier opposed thereto when a development voltage is applied to the developer carrier and a potential on the image carrier surface is equal to a potential on a non-image section.

3. The development apparatus according to claim 2, wherein the apparatus is not provided with a developer replacement unit which once removes part of the developer from a location on the surface of the developer carrier after development and then supplies a new developer to the location after removal of the developer.

4. The development apparatus according to claim 2, wherein the apparatus further comprises a developer replacement unit which once removes part of the developer from a location on the surface of the developer carrier after development and then supplies a new developer to the location after removal of the developer.

5. The development apparatus according to claim 2, wherein the absolute value |Vg−Vb| of a difference between Vb and Vg is smaller than the maximum |Vi−Vb|(MAX) of the absolute value of a difference between Vi and Vb, when toner on the developer carrier opposes to a non-image section containing the ground section on the surface of the image carrier in a contact or non-contact state, where Vb denotes a DC component effective value in a development bias voltage applied to the developer carrier; Vg denotes a potential at a non-image section on the surface of the image carrier; and Vi denotes a potential at an image section on the surface of the image carrier.

6. The development apparatus according to claim 2, wherein an amount of toner supplied to the developer carrier, a thickness of the toner layer and a parameter condition of the development bias are determined to allow a value (Mmin×X) obtained from Mmin multiplied by X to have a value not less than 80% of a development toner amount per unit area, where Mmin denotes the minimum toner amount per unit area of an amount of toner (m/a) held immediately before development on the surface of the developer carrier; X denotes a linear velocity ratio between the developer carrier and the image carrier; and Mmax denotes the maximum toner amount immediately before development.

7. The development apparatus according to claim 2, further comprising a restriction blade which frictionally contacts with the developer held on the surface of the developer carrier to flatten the developer.

8. The development apparatus according to claim 5, wherein the toner is determined to have a relative permittivity not less than 3 and a volume resistivity not less than $10^{10}$ Ω×cm.

9. The development apparatus according to claim 6, wherein the linear velocity ratio between the developer carrier and the image carrier is determined not less than 1.1-fold and a toner covering rate over the surface of the developer carrier is determined not less than the densest covering rate in a single toner layer.

10. The development apparatus according to claim 7, wherein the restriction blade includes a rotary member composed of a deformable member so as to deform the surface of the restriction blade along the surface feature of the developer carrier when the restriction blade is pressed against the surface of the developer carrier.

11. A development apparatus, comprising:

a developer carrier which carries a toner-containing developer held on the surface thereof, the toner having a relative permittivity not more than 4 and a volume resistivity not more than $10^{15}$ Ωcm;

a unit which forms the developer into a thin layer on the surface of the developer carrier; and a unit which charges toner held on the surface of the developer carrier, in which the developer held on the developer carrier is employed in a development region, in which the developer carrier opposes to an image carrier which carries an electrostatic latent image formed on the surface thereof, to develop the electrostatic latent image formed on the image carrier to form a toner image on the image carrier, wherein the apparatus comprises a conductive member for use in contact with a toner layer held on the surface of the developer carrier after development, the conductive member having a DC component potential kept identical to the potential of the developer carrier and a resistivity not more than $10^{8}$ Ω.

12. The development apparatus according to claim 11, wherein an amount of toner supplied to the developer carrier, a thickness of the toner layer and a parameter condition of the development bias are determined to allow a value (Mmin×X) obtained from Mmin multiplied by X to have a value not less than 80% of a development toner amount per unit area, where Mmin denotes the minimum toner amount per unit area of an amount of toner (m/a) held immediately before development on the surface of the developer carrier; X denotes a linear velocity ratio between the developer carrier and the image carrier; and Mmax denotes the maximum toner amount immediately before development.

13. The development apparatus according to claim 11, further comprising a restriction blade which frictionally contacts with the developer held on the surface of the developer carrier to flatten the developer.

14. The development apparatus according to claim 11, wherein the DC component potential on the conductive member is kept not more than a potential difference of the absolute value |Vg−Vb| of the difference between the development bias Vb and the potential Vg at the non-image section on the image carrier.

15. The development apparatus according to claim 12, wherein the linear velocity ratio between the developer carrier and the image carrier is determined not less than 1.1-fold and a toner covering rate over the surface of the developer carrier is determined not less than the densest covering rate in a single toner layer.

16. The development apparatus according to claim 13, wherein the restriction blade includes a rotary member composed of a deformable member so as to deform the surface of the restriction blade along the surface feature of the developer carrier when the restriction blade is pressed against the surface of the developer carrier.

17. A development apparatus, comprising:

a developer carrier which carries a developer containing magnetic particles;

a toner carrier opposed to the developer carrier at a toner passing region; and a toner passing magnetic pole opposed to the toner passing region for rising the developer on the developer carrier, in which the magnetic pole is operative to pass toner from the developer held on the developer carrier to the toner carrier, and the toner passed to the toner carrier is operative to visualize an electrostatic latent image on an image carrier opposed to the toner carrier at a development region in which the toner carrier opposing to the image carrier, wherein the apparatus comprises a unit which controls an amount of charge on the toner, q/m, to satisfy the following relation $$|Q2|-|Q1|/|Q1|\leqq\pm0.45$$

where Q1 denotes an average amount of charge on toner immediately after passed through a region between the developer carrier and the image carrier opposed thereto when a potential difference between the developer carrier and the image carrier surface is equal to 0V, and Q2 denotes an average amount of charge on toner immediately after passed through the region between the developer carrier and the image carrier opposed thereto when a development voltage is applied to the developer carrier and a potential on the image carrier surface is equal to a potential on a non-image section.

18. An image formation apparatus, comprising:

an image carrier;

a write unit which writes a latent image in the surface of the image carrier;

a development unit which converts the latent image written by the write unit on the image carrier into a toner image; and a transfer unit which transfers the toner image formed by the development unit on the image carrier to a transfer material, wherein the development unit includes a developer carrier which carries a toner-containing developer held on the surface thereof;

a unit which forms the developer into a thin layer on the surface of the developer carrier; and a unit which charges toner held on the surface of the developer carrier, in which the developer held on the developer carrier is employed in a development region, where the developer carrier opposing to an image carrier which carries an electrostatic latent image formed on the surface thereof, to develop the electrostatic latent image formed on the image carrier to form a toner image on the image carrier, wherein the apparatus comprises a unit which controls an amount of charge on the toner, q/m, to satisfy the following relation $$|Q2|-|Q1|/|Q1|\leqq\pm0.45$$

where Q1 denotes an average amount of charge on toner immediately after passed through a region between the developer carrier and the image carrier opposed thereto when a potential difference between the developer carrier and the image carrier surface is equal to 0V, and Q2 denotes an average amount of charge on toner immediately after passed through the region between the developer carrier and the image carrier opposed thereto when a development voltage is applied to the developer carrier and a potential on the image carrier surface is equal to a potential on a non-image section.

19. An image formation apparatus, comprising:

an image carrier;

a write unit which writes a latent image in the surface of the image carrier;

a development unit which converts the latent image written by the write unit on the image carrier into a toner image; and a transfer unit which transfers the toner image formed by the development unit on the image carrier to a transfer material, wherein the development unit includes a developer carrier which carries a toner-containing developer held on the surface thereof, the toner having a relative permittivity not more than 4 and a volume resistivity not more than $10^{15}$ Ωcm;

a unit which forms the developer into a thin layer on the surface of the developer carrier; and a unit which charges toner held on the surface of the developer carrier, in which the developer held on the developer carrier is employed in a development region, in which the developer carrier opposes to an image carrier which carries an electrostatic latent image formed on the surface thereof, to develop the electrostatic latent image formed on the image carrier to form a toner image on the image carrier, wherein the apparatus comprises a conductive member for use in contact with a toner layer held on the surface of the developer carrier after development, the conductive member having a DC component potential kept identical to the potential of the developer carrier and a resistivity not more than $10^{8}$ Ω.

20. An image formation apparatus, comprising:

an image carrier;

a write unit which writes a latent image in the surface of the image carrier;

a development unit which converts the latent image written by the write unit on the image carrier into a toner image; and a transfer unit which transfers the toner image formed by the development unit on the image carrier to a transfer material, wherein the development unit includes a developer carrier which carries a developer containing magnetic particles;

a toner carrier opposed to the developer carrier at a toner passing region; and a toner passing magnetic pole opposed to the toner passing region for rising the developer on the developer carrier, in which the magnetic pole is operative to pass toner from the developer held on the developer carrier to the toner carrier, and the toner passed to the toner carrier is operative to visualize an electrostatic latent image on an image carrier opposed to the toner carrier at a development region in which the toner carrier opposing to the image carrier, wherein the apparatus comprises a unit which controls an amount of charge on the toner, q/m, to satisfy the following relation $$|Q2|-|Q1|/|Q1|\leqq\pm0.45$$

where Q1 denotes an average amount of charge on toner immediately after passed through a region between the developer carrier and the image carrier opposed thereto when a potential difference between the developer carrier and the image carrier surface is equal to 0V, and Q2 denotes an average amount of charge on toner immediately after passed through the region between the developer carrier and the image carrier opposed thereto when a development voltage is applied to the developer carrier and a potential on the image carrier surface is equal to a potential on a non-image section.

21. An image formation apparatus, comprising:

an image carrier;

a charger unit which uniformly charges the surface of the image carrier;

an optical system for forming a latent image in the surface uniformly charged by the charger unit on the image carrier by exposing the surface of the image carrier to light;

a development unit equipped with a developer carrier which carries a developer;

a unit which applies a development bias to a development region in which the developer carrier opposes to the image carrier; and a unit which transfers a toner image formed by the development unit on the image carrier to a transfer material, wherein the development unit includes a developer carrier which carries a toner-containing developer held on the surface thereof;

a unit which forms the developer into a thin layer on the surface of the developer carrier; and a unit which charges toner held on the surface of the developer carrier, in which the developer held on the developer carrier is employed in a development region, where the developer carrier opposing to an image carrier which carries an electrostatic latent image formed on the surface thereof, to develop the electrostatic latent image formed on the image carrier to form a toner image on the image carrier, wherein the apparatus comprises a unit which controls an amount of charge on the toner, q/m, to satisfy the following relation $$|Q2|-|Q1|/|Q1|\leqq\pm0.45$$

where Q1 denotes an average amount of charge on toner immediately after passed through a region between the developer carrier and the image carrier opposed thereto when a potential difference between the developer carrier and the image carrier surface is equal to 0V, and Q2 denotes an average amount of charge on toner immediately after passed through the region between the developer carrier and the image carrier opposed thereto when a development voltage is applied to the developer carrier and a potential on the image carrier surface is equal to a potential on a non-image section, and wherein the following relation $$0<|VD|-|VB|<|VD-VL|<400\text{V}$$

where VD denotes a potential at a dark section in the surface of the image carrier; VL denotes a surface potential of the image carrier after exposure; and VB denotes the development bias is satisfied.

22. An image formation apparatus, comprising:

an image carrier;

a charger unit which uniformly charges the surface of the image carrier;

an optical system for forming a latent image in the surface uniformly charged by the charger unit on the image carrier by exposing the surface of the image carrier to light;

a development unit equipped with a developer carrier which carries a developer;

a unit which applies a development bias to a development region in which the developer carrier opposes to the image carrier; and a unit which transfers a toner image formed by the development unit on the image carrier to a transfer material, wherein the development unit includes a developer carrier which carries a toner-containing developer held on the surface thereof;

a unit which forms the developer into a thin layer on the surface of the developer carrier; and a unit which charges toner held on the surface of the developer carrier, in which the developer held on the developer carrier is employed in a development region, in which the developer carrier opposes to an image carrier which carries an electrostatic latent image formed on the surface thereof, to develop the electrostatic latent image formed on the image carrier to form a toner image on the image carrier, wherein the apparatus comprises a conductive member for use in contact with a toner layer held on the surface of the developer carrier after development, the conductive member having a DC component potential kept identical to the potential of the developer carrier and a resistivity not more than $10^8$ Ω, and wherein the following relation $$0<|VD|-|VB|<|VD-VL|<400\text{V}$$

where VD denotes a potential at a dark section in the surface of the image carrier; VL denotes a surface potential of the image carrier after exposure; and VB denotes the development bias is satisfied.

23. An image formation apparatus, comprising:

an image carrier;

a charger unit which uniformly charges the surface of the image carrier;

an optical system for forming a latent image in the surface uniformly charged by the charger unit on the image carrier by exposing the surface of the image carrier to light;

a development unit equipped with a developer carrier which carries a developer;

a unit which applies a development bias to a development region in which the developer carrier opposes to the image carrier; and a unit which transfers a toner image formed by the development unit on the image carrier to a transfer material, wherein the development unit includes a developer carrier which carries a developer containing magnetic particles;

a toner carrier opposed to the developer carrier at a toner passing region; and a toner passing magnetic pole opposed to the toner passing region for rising the developer on the developer carrier, in which the magnetic pole is operative to pass toner from the developer held on the developer carrier to the toner carrier, and the toner passed to the toner carrier is operative to visualize an electrostatic latent image on an image carrier opposed to the toner carrier at a development region in which the toner carrier opposing to the image carrier, wherein the apparatus comprises a unit which controls an amount of charge on the toner, q/m, to satisfy the following relation $$|Q2|-|Q1|/|Q1|\leqq\pm0.45$$

where Q1 denotes an average amount of charge on toner immediately after passed through a region between the developer carrier and the image carrier opposed thereto when a potential difference between the developer carrier and the image carrier surface is equal to 0V, and Q2 denotes an average amount of charge on toner immediately after passed through the region between the developer carrier and the image carrier opposed thereto when a development voltage is applied to the developer carrier and a potential on the image carrier surface is equal to a potential on a non-image section, and wherein the following relation $$0<|VD|-|VB|<|VD-VL|<400\text{V}$$

where VD denotes a potential at a dark section in the surface of the image carrier; VL denotes a surface potential of the image carrier after exposure; and VB denotes the development bias is satisfied.

24. A process cartridge for use in an image formation apparatus, the image formation apparatus including:

an image carrier;

a charger unit which charges the surface of the image carrier;

a write unit which writes a latent image in the surface of the image carrier;

a development unit which converts the latent image written by the write unit on the image carrier into a toner image;

a transfer unit which transfers the toner image formed by the development unit on the image carrier to a transfer material; and a cleaner unit which removes residual toner on the image carrier after transfer of the toner image to the transfer material, wherein the process cartridge is configured attachable to and detachable from the body of the image formation apparatus, for supporting the image carrier and at least one of the development unit, the charger unit, the transfer unit and the cleaner unit integrally, and wherein the development unit includes a developer carrier which carries a toner-containing developer held on the surface thereof;

a unit which forms the developer into a thin layer on the surface of the developer carrier; and a unit which charges toner held on the surface of the developer carrier, in which the developer held on the developer carrier is employed in a development region, where the developer carrier opposing to an image carrier which carries an electrostatic latent image formed on the surface thereof, to develop the electrostatic latent image formed on the image carrier to form a toner image on the image carrier, wherein the apparatus comprises a unit which controls an amount of charge on the toner, q/m, to satisfy the following relation $$|Q2|-|Q1|/|Q1|\leqq\pm0.45$$

where Q1 denotes an average amount of charge on toner immediately after passed through a region between the developer carrier and the image carrier opposed thereto when a potential difference between the developer carrier and the image carrier surface is equal to 0V, and Q2 denotes an average amount of charge on toner immediately after passed through the region between the developer carrier and the image carrier opposed thereto when a development voltage is applied to the developer carrier and a potential on the image carrier surface is equal to a potential on a non-image section.

25. A process cartridge for use in an image formation apparatus, the image formation apparatus including:

an image carrier;

a charger unit which charges the surface of the image carrier;

a write unit which writes a latent image in the surface of the image carrier;

a development unit which converts the latent image written by the write unit on the image carrier into a toner image;

a transfer unit which transfers the toner image formed by the development unit on the image carrier to a transfer material; and a cleaner unit which removes residual toner on the image carrier after transfer of the toner image to the transfer material, wherein the process cartridge is configured attachable to and detachable from the body of the image formation apparatus, for supporting the image carrier and at least one of the development unit, the charger unit, the transfer unit and the cleaner unit integrally, and wherein the development unit includes a developer carrier which carries a toner-containing developer held on the surface thereof, the toner having a relative permittivity not more than 4 and a volume resistivity not more than $10^{15}$ $\Omega cm$;

a unit which forms the developer into a thin layer on the surface of the developer carrier; and a unit which charges toner held on the surface of the developer carrier, in which the developer held on the developer carrier is employed in a development region, in which the developer carrier opposes to an image carrier which carries an electrostatic latent image formed on the surface thereof, to develop the electrostatic latent image formed on the image carrier to form a toner image on the image carrier, wherein the apparatus comprises a conductive member for use in contact with a toner layer held on the surface of the developer carrier after development, the conductive member having a DC component potential kept identical to the potential of the developer carrier and a resistivity not more than $10^8$ Ω.

26. A process cartridge for use in an image formation apparatus, the image formation apparatus including:

an image carrier;

a charger unit which charges the surface of the image carrier;

a write unit which writes a latent image in the surface of the image carrier;

a development unit which converts the latent image written by the write unit on the image carrier into a toner image;

a transfer unit which transfers the toner image formed by the development unit on the image carrier to a transfer material; and a cleaner unit which removes residual toner on the image carrier after transfer of the toner image to the transfer material, wherein the process cartridge is configured attachable to and detachable from the body of the image formation apparatus, for supporting the image carrier and at least one of the development unit, the charger unit, the transfer unit and the cleaner unit integrally, and wherein the development unit includes a developer carrier which carries a developer containing magnetic particles;

a toner carrier opposed to the developer carrier at a toner passing region; and a toner passing magnetic pole opposed to the toner passing region for rising the developer on the developer carrier, in which the magnetic pole is operative to pass toner from the developer held on the developer carrier to the toner carrier, and the toner passed to the toner carrier is operative to visualize an electrostatic latent image on an image carrier opposed to the toner carrier at a development region in which the toner carrier opposing to the image carrier, wherein the apparatus comprises a unit which controls an amount of charge on the toner, q/m, to satisfy the following relation $$|Q2|-|Q1|/|Q1| \leqq \pm 0.45$$

where Q1 denotes an average amount of charge on toner immediately after passed through a region between the developer carrier and the image carrier opposed thereto when a potential difference between the developer carrier and the image carrier surface is equal to 0V, and Q2 denotes an average amount of charge on toner immediately after passed through the region between the developer carrier and the image carrier opposed thereto when a development voltage is applied to the developer carrier and a potential on the image carrier surface is equal to a potential on a non-image section.

* * * * *